US005707404A

United States Patent [19]

Andrews et al.

[11] Patent Number: 5,707,404

[45] Date of Patent: Jan. 13, 1998

[54] FORMALDEHYDE FREE METHOD FOR IMPARTING PERMANENT PRESS PROPERTIES TO COTTON AND COTTON BLENDS

[75] Inventors: George A. Andrews; Joseph Peterson, both of Auburn; William Hough, Tuskegee, all of Ala.

[73] Assignee: WestPoint Stevens, Inc., West Point, Ga.

[21] Appl. No.: 181,501

[22] Filed: Jan. 14, 1994

[51] Int. Cl.[6] ..... D06M 13/352

[52] U.S. Cl. ..... 8/189; 8/181; 8/185; 8/186

[58] Field of Search ..... 8/181, 185, 186, 8/189; 528/245

[56] References Cited

U.S. PATENT DOCUMENTS

| | | | |
|---|---|---|---|
| 3,112,156 | 11/1963 | Vail et al. . | |
| 4,284,758 | 8/1981 | North | 528/245 |
| 4,295,846 | 10/1981 | Petersen et al. | 8/186 |
| 4,300,898 | 11/1981 | North | 8/185 |
| 4,345,063 | 8/1982 | North | 8/185 |
| 4,455,416 | 6/1984 | Floyd et al. | 528/245 |
| 4,505,712 | 3/1985 | Floyd et al. | 8/180 |
| 4,619,668 | 10/1986 | Frick, Jr. et al. | 8/496 |
| 4,625,029 | 11/1986 | Floyd et al. | 544/309 |
| 5,021,263 | 6/1991 | Kästele et al. | 427/353 |

FOREIGN PATENT DOCUMENTS

| | | |
|---|---|---|
| 345566 | 12/1989 | European Pat. Off. . |
| 359039 | 3/1990 | European Pat. Off. . |
| 110976 | 5/1987 | Japan . |
| 75471 | 3/1989 | Japan . |
| 1489961 | 10/1977 | United Kingdom . |

*Primary Examiner*—Alan Diamond

*Attorney, Agent, or Firm*—Pennie & Edmonds LLP

[57] ABSTRACT

An improved method of treating a fabric comprising the step of contacting a fabric with the cis isomer of a compound having the general formula;

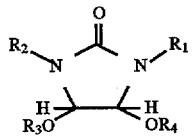

wherein $R_1$, $R_2$, $R_3$, and $R_4$ are the same or different and each of $R_1$, $R_2$, $R_3$, and $R_4$ represent branched or straight chain alkyl, carbocyclic or aryl.

2 Claims, No Drawings

FORMALDEHYDE FREE METHOD FOR IMPARTING PERMANENT PRESS PROPERTIES TO COTTON AND COTTON BLENDS

BACKGROUND OF THE INVENTION

1. Field of the Invention

This invention relates to an improved process of using the reaction product of a dialkyl urea, glyoxal and boric acid to impart permanent press qualities to a fabric without the use of formaldehyde.

2. Description of the Prior Art

Aminoplast resins have been known and used to improve the crease resistance and dimensional stability of textile fabrics for many years. Aminoplast resins are typically compounds such as alkoxymethylated or hydroxymethylated ureas, cyclic ureas, carbamates, amides or aminotriazinines which contain alkoxymethyl or hydroxymethyl groups which react with hydroxy groups in cellulose to cause crosslinking with the formation of acetal groups. Crosslinking of cellulose is generally considered to improve the interaction between individual fibers making up a fabric thereby improving the fabric's ability to retain its dimension, smooth appearance and normal shape.

There are numerous problems associated with the use of aminoplast resins to finish fabrics. First there is a loss of mechanical strength in the cellulose fibers that results from aminoplast resin treatment. Another problem is the presence of formaldehyde which accompanies the use of aminoplast resin treatment of fabrics.

Formaldehyde is a strong physical irritant and allergen which has an unpleasant odor. The presence of small amounts of formaldehyde can cause tearing and rashes in addition to other negative physical effects. Workers who make fabric finishing agents containing formaldehyde, personnel who apply the agent to fabric and the end user of the fabric can all be affected by formaldehyde.

Thus there is a need for formaldehyde free treating agents for fabrics. Formaldehyde free finishing agents are known and have been described in the prior art. For example, U.S. Pat. No. 3,112,156 discloses the use of isomeric mixtures of 1,3- dimethyl-4,5-dihydroxy-2-imidazolidinone compounds which can be used to treat fabrics. Such imidazolidinone compounds are made by reacting a methyl urea and glyoxal under basic conditions at a pH of greater than 7. The formation of finishing agents under these conditions lead to the formation of a mixture of the cis and trans isomers of said imidazolidinone compound in which the trans isomer predominates. U.S. Pat. Nos. 4,770,668, 4,295,846, 4,300,898, 4,332,586, 4,345,063, 4,284,758, each describe various ethylene urea compounds that can be used to treat fabric without the use of formaldehyde and still impart permanent press qualities. None of these patents disclose the use of the cis isomer Imidazolidinone compounds and no process has been found to be completely satisfactory.

There thus exists a continuing need for compounds which can be used as cellulose crosslinking agents which can impart a high degree of permanent press properties and smoothability to fabrics. There is also a continuing need for compounds that accomplish these ends without the use of formaldehyde.

SUMMARY OF THE INVENTION

This invention relates to an improved formaldehyde free method of imparting permanent press qualities to a fabric comprising the step of contacting a fabric with the cis isomer of a compound having the general formula;

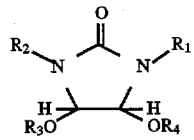

wherein $R_1$, $R_2$, $R_3$, and $R_4$ are the same or different and each of $R_1$, $R_2$, $R_3$, and $R_4$ represent branched or straight chain alkyl, carbocyclic or aryl.

The invention also relates to a novel method of producing stereoisomeric mixtures of compounds of general formula I in which the cis isomer of the particular compound is present in a larger amount than the trans isomer.

Still further this invention relates to the use of a catalyst combining both magnesium fluoborate and magnesium chloride in a method to treat fabrics with compositions comprising the cis isomers of compounds having the general formula I.

DETAILED DESCRIPTION OF THE INVENTION

This invention is related the cis isomers of compounds having the general formula:

FORMULA I

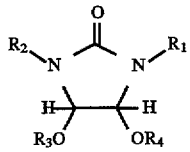

wherein $R_1$, $R_2$, $R_3$, and $R_4$ are the same or different and each of $R_1$, $R_2$, $R_3$, and $R_4$ represent linear or branched chain alkyl, carbocyclic or aryl groups.

As used herein, the phrase linear chain or branched chained alkyl groups of up to about 20 carbon atoms means any substituted or unsubstituted acyclic carbon-containing compounds, including alkanes, alkenes and alkynes. Examples of alkyl groups include lower alkyl, for example, methyl, ethyl, n-propyl, iso-propyl, n-butyl, iso-butyl or tert-butyl; upper alkyl, such as, octyl, nonyl, decyl, and the like; and lower alkenyl, for example, ethenyl, propenyl, propyldienyl, butenyl, butyldienyl, and the like. The ordinary skilled artisan is familiar with numerous linear and branched alkyl groups, which are within the scope of the present invention.

In addition, such alkyl groups may also contain various substituents in which one or more hydrogen atoms has been replaced by a functional group. Functional groups include but are not limited to hydroxyl, amino, carboxyl, amide, ester, ether, and halogen (fluorine, chlorine, bromine and iodine), to mention but a few. Examples of alkyl groups containing substituents are for instance $—(—CH_2CH_2—O—)_n—H$ where n is 1–20, such as in particular, ethylene glycol and diethylene glycol and $—(—CH_2CH(CH_3)—O—)_n—H$ where n is 1–20 such as propylene glycol and dipropylene glycol.

As used herein, substituted and unsubstituted carbocyclic groups of up to about 20 carbon atoms means cyclic carbon-containing compounds, including but not limited to cyclopentyl, cyclohexyl, cycloheptyl, adamantyl, and the like. Such cyclic groups may also contain various substituents in which one or more hydrogen atoms has been replaced by a functional group. Such functional groups include those described above, and lower alkyl groups as described above. The cyclic groups of the invention may further comprise a heteroatom such as nitrogen or oxygen as a part of the ring structure.

As used herein, substituted and unsubstituted aryl groups means a hydrocarbon ring bearing a system of conjugated double bonds, usually comprising six or more even number of π (pi) electrons. Examples of aryl groups include, but are not limited to, phenyl, naphthyl, anisyl, toluyl, xylenyl and the like. According to the present invention, aryl also includes heteroaryl groups, e.g., pyrimidine or thiophene. These aryl groups may also be substituted with any number of a variety of functional groups. In addition, to the functional groups described above in connection with substituted alkyl groups and carbocyclic groups, functional groups on the aryl groups can be nitro groups.

As mentioned above, $R_1$, $R_2$, $R_3$, and $R_4$ can also represent any combination of alkyl, carbocyclic or aryl groups, for example, 1-cyclohexylpropyl, benzyl cyclohexylmethyl, 2-cyclohexylpropyl, 2, 2-methylcyclohexylpropyl, 2,2-methylphenylpropyl, 2, 2-methylphenylbutyl.

In particular, the compounds of the invention must satisfy those requirements that enable them to be used in a method of treating textiles. This means that $R_1$, $R_2$, $R_3$, and $R_4$ will be chosen to impart in the compound those properties known to the skilled artisan, such as water solubility, volatility, cost, and compatibility with other textile processing additives solubility, that will allow facile use of the compounds in the method of the invention.

According to formula I there can be two cis isomers of the compounds of formula I. These isomers are those compounds in which the two hydroxyl or alkoxy groups at the 4 and 5 position of the ring structure of the compound according to Formula I, extend into the region above the plane of the five member ring. The cis isomer may also be that compound in which both hydroxyl or alkoxy groups extend into the region below the plane of the compounds as illustrated below.

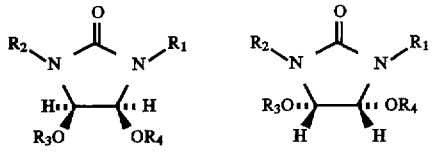

It has been determined that the cis isomer has a more potent crosslinking effect than the trans isomer of this class of compounds. In particular, it has been found that compositions containing a majority of the cis isomer of compounds of formula I have an improved cellulose crosslinking effect.

The compounds of the present invention can be synthesized by many routes. It is well known in the art of organic synthesis that many different synthetic protocols can be used to prepare a given compound. Different routes can involve more or less expensive reagents, easier or more difficult separation or purification procedures, straightforward or cumbersome scale-up, and higher or lower yield. The skilled synthetic organic chemist knows well how to balance the competing characteristics of synthetic strategies. Thus the compounds of the present invention are not limited by the choice of synthetic strategy, and any synthetic strategy that yields the compounds described above can be used.

In a preferred method of making an isomeric mixture in which the cis isomer is present in a greater amount than the trans isomer, the cis isomer is made by the reaction of stoichiometric amounts of di-alkyl urea and glyoxal in the presence of boric acid at a pH of less than about 3 or more preferably at a pH of less than about 2 according to the following general reaction;

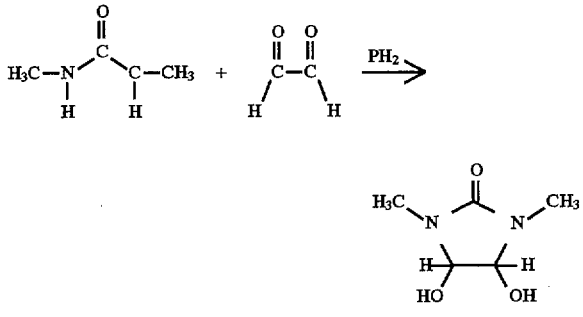

When all of the reactants are added to a reaction vessel the pH is adjusted to under about 2.

It has been found that when boric acid, as opposed to any other acid, is used as a catalyst during this reaction the cis isomers of the compounds of formula 1 are favored and a majority of the resulting product comprising both cis and trans isomers is the cis isomer. This reaction has particular importance because, as described above, it has been found that the cis isomer has more potent cellulose crosslinking effect.

The pH of the reaction should be less than 2. At pH's of more than about 3½ no reaction takes place between the reactants, or at least no reaction takes place within a reasonable time. If the pH is between 2 and 3½ the reaction takes much more time that at pH below about 2. At a pH of less than about 2 the reaction can be accomplished in about 1 hour. The pH can be adjusted using boric acid.

The starting temperature of the reaction should be from about 15°–30° C. or more preferably between about 20° and 27° C. After all of the reactants have been combined the temperature of the reaction vessel can be increased to about 35° C. at which temperature a significant exotherm is observed. The exotherm continues to about 45° C. The temperature of the reaction can then increased to about 60° C. until the reaction is complete. Temperatures above about 60° C. can cause considerable discoloration of the product.

The reaction can usually be completed in under about an hour although when the react is conducted at pH's of up to about 3½ the reaction can take a significantly longer time of up to about eight hours. The amount of glyoxal can be monitored to ascertain the end point of the reaction. The end point is usually when there is less than about 0.5% of unreacted glyoxal.

After production of the cis isomer it is preferred to further react the cis isomer with magnesium fluoborate and magnesium chloride prior to adding the compound to a composition to be added to a fabric.

Upon formation of the dialkyl, dihydroxy imidazolidinone compound according to the above described general reaction, the hydroxy groups can be alkylated to form alkoxy groups. The alkoxylation can be accomplished by any method known to one of ordinary skill in the art.

In a preferred method of alkylating the hydroxy groups at the 4 and 5 position of the ring the product of the reaction of the dialkyl urea, glyoxal and boric acid can be partially neutralized to a pH of between about 3 to about 5 with sodium metaborate and caustic soda. The caustic soda aids the solubility of the sodium metaborate. Alkylation of the hydroxy groups can then be accomplished using an alcohol of the group to be added and a base, according to reactions well known to those skilled in the art.

This reaction scheme is advantageous because of the relatively short period of time in which the reaction takes place and because of the limited number of reactants that are needed for the reaction.

Other methods of obtaining the cis isomer of a compound of formula I can also be used. For example, a stereoisomeric mixture of a di alkyl, di hydroxy imidazolidinone can be separated using existing separation technology to separate a stereoisomeric mixture of compounds according to formula I. The separated isomers can then be recombined so that the cis isomer is present in a greater amount than the trans isomer. Reaction of a dialkyl urea and glyoxal with boric acid to make the cis isomer would seem to be more advantageous because of the cost and time requirements of alternate separation procedures.

Compositions using the cis isomer of compounds of formula I can be used to crosslink cellulose in fabrics. Such compositions can include both the cis and trans isomers of a compound of formula I, however it is preferred that the compositions comprise at least about 51% cis isomer with compositions comprising more than about 65% being more preferred and compositions comprising more than about 85% being most preferred. In certain circumstances it may be preferable to have compositions which comprise substantially all cis isomer having substantially no trans isomer present.

Improved compositions for treating fabrics according to the invention can include from about 1% to about 40%, or more preferably from about 5% to about 20% of an isomeric mixture of a compound having the general Formula 1. Other additives and water can make up the rest of the composition.

In addition to compounds according to formula I, the compositions of the invention may include other well known fabric treating additives including water repellent agents such as, for example, aluminum- or zirconium-containing paraffin wax emulsions and silicone-containing formulations; softening agents such as oxyethylation products of higher fatty acids, fatty alcohols and fatty acid amides, relatively high molecular weight polyglycol ethers, higher fatty acids, fatty alcohol-sulfonates and N-stearyl-urea compounds; leveling agents such as for instance water-soluble salts of acidic esters from polybasic acids and ethylene oxide or propylene oxide adducts of relatively long-chain base molecules capable of undergoing oxyalkylation; and, wetting agents such as salts of alkylnaphthalenesulfonic acids, alkali metal salts of dioctyl sulfosuccinate, and the adducts of alkylene oxides with fatty alcohols, alkylphenols, fatty amines and the like. Resin finishes and agents for modifying the hand may also be used. Examples of resin finishes are cellulose ethers, cellulose esters and alginates, as well as solutions or dispersions of synthetic polymers and polycondensates, e.g., of polyethylene, nylons, oxyethylated nylons, polyvinyl ethers, polyvinyl alcohols, polyacrylic acid, polyacrylates and poly acrylamides, the corresponding polymethacrylic compounds, polyvinyl propionate, polyvinylpyrrolidone, and copolymers, for example of vinyl chloride and acrylic acid esters, of butadiene and styrene or acrylonitrile, or of 1,1-dichloroethylene, β-chloroalkyl acrylates or vinyl ethyl ether and acrylamide, or the amides of crotonic acid and maleic acid. Suitable agents for modifying the hand can be, for instance, polyvinyl acetate and polyacrylates and, if desired, mixtures thereof. Coloring agents and pigments such as Blackman-Uhler Yellow pigment 4EH and pigment binders such as Tancobind 704 and can also be used in the compositions of the invention.

Other conventional additives such as lubricants, bodying agents, water repellents, flame retardants, soil shedding agents, mildew inhibitors, anti-wet soiling agents, fluorescent brighteners, and the like can also be used in the compositions of the invention. Such auxiliaries must not, however, interfere with the inventive function of the cis isomer of compounds of formula I, and must not themselves have a deleterious effect on fiber strength, shrinkage, or wash appearance of the fabric. Also any additives will be preferably free of formaldehyde.

Compositions of this invention can be used to treat fabric to impart permanent press qualities to said fabric without the use or release of formaldehyde.

The improved fabric treating compositions of this invention are useful with both woven and non woven fabrics that use fibers comprising cellulose. Compositions of this invention are more effective when the cellulose content of the fabric is above about 20%. Other fabrics containing fibers with hydrophilic groups such as free hydroxyl groups can also be treated with these compositions.

Fabrics using natural fibers such as cotton, rayon, ramie, hemp and linen can be treated with the compositions of the invention. The compositions may also be used on blends of fabrics that include both natural and synthetic fibers. Examples of these blends are, for example, polyester/cotton, polyester/rayon, and rayon/wool blends.

Both white and colored fabrics such as bleached, printed, dyed, yarn-dyed and cross-dyed fabrics can be effectively treated with the resins of this invention.

The improved fabric treating agents can be used to treat a fabric in any manner known to those skilled in the art. One such method includes the incorporation of an inventive fabric treating composition into a solution and applying the solution to a fabric, removing excess solution, drying and then curing. Each of these steps is well known in the art and can be accomplished by any of the methods detailed in "Chemical After Treatment Of Textiles", Mark et al, J. Wiley and Sons, 1971, "Chemical Processing Of Synthetic Fibers and Blends", Kvdotye and Vaidya, J. Wiley and Sons, 1984, "Handbook Of Textile Finishing", A. J. Hall, National Trade Press Limited, 1957, Volume 65 of the AATCC Technical Manual, 1990, and "Engineering and Textile Coloration", C. Duckworth, Dyers Company Publications Trust, 1983, the relevant portions of which are herein specifically incorporated by reference.

For example the solution may be applied to a fabric by any manner known to those skilled in the art. Application can be accomplished for instance by spraying, dipping or padding for example.

When applying the compositions of this invention to a fabric, there generally will be present an appropriate catalyst. Typical catalysts include acids such as fluoboric, acetic, glycolic, maleic, lactic, citric, tartaric, and oxalic acids; metal salts such as magnesium chloride, nitrate, fluoborate, or fluosilicate; zinc chloride, nitrate, fluoborate, or fluosilicate; ammonium chloride; zirconium oxychloride; sodium or potassium bisulfate; amine hydrochlorides such as the hydrochloride of 2-amino-2- methyl-1-propanol; and the like, and mixtures thereof. The preferred catalyst is a mixture of from about 75–95% magnesium chloride and from about 25–5% magnesium fluoroborate. The amount of catalyst generally is about. 0.01 to 10 percent, and preferably about 0.05 to 5 percent, based on the weight of the padding bath.

The amount of treating agent which is applied to the fabric will depend upon the type of fabric and its intended application. In general it is about 0.1% to about 15%, and preferably about 2% to about 8%, based on the weight of the fabric.

In the process of treating fabrics with the blends of this invention, the fabric is impregnated with an aqueous or alcoholic solution of the finishing resins, and the impregnated fabric is then dried and cured; the drying and curing steps may be consecutive or simultaneous.

If desired, the textile fabric may be finished by post-curing which is also known as deferred or delayed curing. This consists of impregnating the fabric with a solution of the finishing resins and catalyst, drying the impregnated material carefully so that the finishing agent does not react, and then, after a prolonged interval, heating the material to a temperature at which the agent reacts under the influence of the catalyst.

All patents, patent applications and other printed publications disclosed are specifically incorporated herein by reference.

EXAMPLES

The following examples are detailed descriptions of the methods of preparation of the fabric treating compounds and compositions of the invention and their use. These detailed preparations fall within the scope of the invention and serve to exemplify the general synthetic procedures which form part of the invention. The following examples are meant for illustrative purposes only and are not intended as a restriction on the scope of the invention. All parts are by weight and all temperatures are in degrees celsius unless otherwise indicated.

Example 1

Preparation of Cis 1,3-N,N'-Dimethyl-4,5-Dihydroxy-2-Imidazolidinone 217.6 g of a 40% glyoxal solution, 136.4 g of dimethyl urea, and 11.1 g of orthoboric acid are charged into a resin kettle equipped with a magnetic stirrer, reflux condenser and a thermometer. The system is stirred at room temperature until all of the boric acid is dissolved. The resulting pH is lowered to approximately 1.75 and the system is slowly heated to 60° C. A significant exotherm is observed between 35° C. and 45° C. The reaction mixture is stirred and heated for one hour at which time a glyoxal analysis is made. When the glyoxal is less than 0.5 percent the mixture is cooled to room temperature. This reaction product can be used with appropriate amounts of catalyst to pad cotton or polycotton or rayon fabrics.

Example 2

Preparation of Cis 1,3-N,N'-Dimethyl-4,5-Dimethoxy-2-Imidazolidinone 96.0 g of methanol and 8.1 g of an aqueous solution of 25% NaOH is added to the product of Example 1. The pH of the reaction is measured to be 5.32. The mixture is heated to 80° C. and maintained at that temperature for one hour. The product can be used in Example 6.

Example 3

Combination of Cis 1,3-N,N'-Dimethyl-4,5-Dimethoxy-2-Imidazolidinone and Catalyst 4.014 parts of glyoxal, 0.836 parts water and 2.509 parts dimethyl urea are charged into a reaction vessel and mixed at room temperature until all ingredients are dissolved. With the temperature below 30° C., 0.194 parts of boric acid are added to the reaction vessel and mixed well. The pH is determined to verify that it is 1.75 ±0.25. The reaction mixture is then heated to 65° C. and held at that temperature for 1 hour. The glyoxal content is then determined to be less than about 0.5% and 0.192 parts of sodium metaborate is added. When the sodium metaborate has dissolved 0.189 parts of magnesium fluoborate is added to the reaction vessel. Then 1.699 parts of magnesium chloride are added to the reaction. 0.193 parts of a solution of 25% NaOH is then added. Finally 0.17 parts of water is added to the mixture. The resulting product can be used with textile treating additives on fabric.

Example 4

Application to Fabric

A formulation comprising 5.40% of the product of Example 3, 2.40% Griffsoft HNP (commercial nonionic polyethylene softener), 1.00% Astrotherm AM (commercial antimigrant, Glo-Tex Chemicals, Inc.), 1.80% Tancobind 704 (commercial melamine pigment binder, Evode-Tanner, Inc.), 0.012% Blackman-Uhler Yellow Pigment 4EH (commercial pigment) and 89.388% water is padded onto a fabric of 100% woven cotton sheeting and passed over a vacuum slot to about 35% wet pick-up. The treated fabric is passed through a pre-dryer and then a three section curing oven with section 1 at 375 degrees F., section 2 at 385 degrees F., and section 3 at 385 degrees F. The fabric exit temperature is 385 degrees F. and the speed of the fabric is 100 yards per min.

The shrinkage of the fabric is measured according to AATCC Method 135 and found to be −3.3%×−2.7% versus the control (bleached and scoured only) which is −12×+2.

The wash appearance is measured by AATCC Method 128 and found to be better than 3.5 versus the control which is 1.0.

Example 5

Application to Fabric

A formulation comprising 13.0% of the product of Example 3, 3.0% Griffcryl 1418 (commercial acrylic emulsion), 1.4% Griffsoft HNP (commercial nonionic polyethylene softener), 1.0% Griffsoft 669 (commercial cationic fabric softener), 2.0% Griffsoft 448 (commercial GMS softener), 1.0% Griffwet BS (commercial wetting agent), and 88.6% water is padded onto a 100% cotton woven and dyed apparel fabric at 60% wet pick-up. The fabric is pre-dried at 200 degrees F. and then cured at 360 degrees F. while running at a speed of 54 yards per minute in an oven. The exit temperature ranges from 340 to 360 degrees F. The fabric is then Sanforized.

The shrinkage of the fabric is measured according to AATCC Method 135 and found to be −5.8%×−2.0% versus the control (untreated) which is −14%×+6%.

The wash appearance is measured by AATCC Method 128 and found to be better than 3.5 versus the control which is 2.0.

Example 6

A 15% solution of the product made in Example 1, 3.4% of an aqueous solution of 64% magnesium chloride, 0.4% of an aqueous solution of 30% magnesium fluoborate, 4.6% Griftsoft 1373 and 76.6% water is prepared. This solution is padded onto a fabric of 100% cotton and a second fabric of a 50/50 polyester/cotton blend to about 60% wet pickup. The wet fabric is dried and cured at 360° F. for 2 minutes.

The shrinkage of the fabric is measured according to AATCC Method 135 and found to be −3.1%×2.0% for the 100% cotton fabric and −3.6%×1.8% for the 50/50 polyester/cotton blend fabric.

The wash appearance is measured by AATCC Method 128 and is found to be better than 3.0 for both the 100% cotton fabric and the 50/50 polyester/cotton blend fabric.

Wrinkle recovery was measured according to AATCC method for the 100% cotton fabric and was found to be 106.

Example 7

A solution of 16.4% of the product of Example 2, 3.4% of an aqueous solution of 64% magnesium chloride, 0.4% of an aqueous solution of 30% magnesium fluoroborate, 4.6% Griftsoft 1373 and 76.6% water is prepared. This solution is padded onto a fabric of 100% cotton and a second fabric of a 50/50 polyester/cotton blend to about 60% wet pickup. The wet fabric is dried and cured at 360° F. for 2 minutes.

The shrinkage of the fabric is measured according to AATCC Method 135 and found to be −2.8%×−1.7% for the 100% cotton fabric and −2.4%×1.5% for the 50/50 polyester/cotton blend fabric.

The wash appearance is measured by AATCC Method 128 and is found to be 3.5 for both the 100% cotton fabric and the 50/50 polyester/cotton blend fabric.

Wrinkle recovery was measured according to AATCC method for the 100% cotton fabric and was found to be 127.2.

The scope of the following claims is intended to encompass all obvious changes in the details, materials, reaction conditions and processes that will occur to one of ordinary skill in the art.

We claim:

1. An improved method of treating a fabric comprising the step of contacting a fabric with predominately the cis isomer of a compound having the general formula:

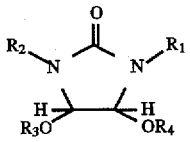

wherein $R_1$, $R_2$, $R_3$ and $R_4$ are the same or different and each of $R_1$ and $R_2$ represent branched or straight chain alkyl, substituted alkyl, carbocyclic, substituted carbocyclic, aryl, or substituted aryl and $R_3$ and $R_4$ are $—(—CH_2CH_2—O—)_n—H$ where n is 1–20.

2. An improved method of treating a fabric comprising the step of contacting a fabric with predominately the cis isomer of a compound having the general formula:

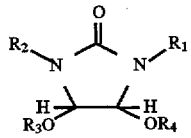

wherein $R_1$, $R_2$, $R_3$ and $R_4$ are the same or different and each of $R_1$ and $R_2$ represent branched or straight chain alkyl, substituted alkyl, carbocyclic, substituted carbocyclic, aryl, or substituted aryl and $R_3$ and $R_4$ are $—(—CH_2CH(CH_3)—O—)_n—H$ where n is 1–20.

* * * * *